US006428265B1

(12) United States Patent
Gilmore, Jr.

(10) Patent No.: US 6,428,265 B1
(45) Date of Patent: Aug. 6, 2002

(54) POWER COUPLING MOUNTING FOR A QUICK-DISCONNECT COUPLING ON A HEAVY-DUTY MACHINE

(75) Inventor: Charles P. Gilmore, Jr., St. Joseph, MO (US)

(73) Assignee: Gilmore Industries, Inc., St. Joseph, MO (US)

( * ) Notice: Subject to any disclaimer, the term of this patent is extended or adjusted under 35 U.S.C. 154(b) by 0 days.

(21) Appl. No.: 09/699,859

(22) Filed: Oct. 30, 2000

(51) Int. Cl.[7] ..... E02F 9/00
(52) U.S. Cl. ..... 414/723; 37/468
(58) Field of Search ..... 414/723, 686, 414/694, 918; 901/29; 37/468

(56) References Cited

U.S. PATENT DOCUMENTS 5,108,252 A * 4/1992 Gilmore, Jr. et al. ... 414/723 X
5,360,313 A 11/1994 Gilmore, Jr. et al.
5,484,250 A 1/1996 Gilmore, Jr. et al.
5,890,871 A 4/1999 Woerman
5,915,837 A 6/1999 Brown et al.
6,042,295 A 3/2000 Barden

* cited by examiner

*Primary Examiner*—Donald W. Underwood
(74) *Attorney, Agent, or Firm*—Lloyd L. Zickert

(57) ABSTRACT

A power coupling mounting for a quick-disconnect coupling between the boom and stick on a heavy-duty machine having coupling elements to connect a power supply from the machine to the stick that eliminates the need for one or more persons to manually connect or disconnect the coupling elements when the quick-disconnect coupling is coupled or uncoupled. The quick-disconnect coupling includes a coupling member mounted on the boom of the machine and a coupling member mounted on the stick. The power coupling includes a male coupling element mounted on the stick coupling member and a female coupling element mounted on the boom coupling member. The female coupling element is slidably mounted on a plate extending from the boom coupling member for orbital movement and the male coupling element is gimbally mounted on a plate extending from the stick coupling member to facilitate alignment of the coupling elements along the X, Y and Z axes during coupling and decoupling of the coupling members.

21 Claims, 7 Drawing Sheets

POWER COUPLING MOUNTING FOR A QUICK-DISCONNECT COUPLING ON A HEAVY-DUTY MACHINE

DESCRIPTION

This invention relates in general to a quick-disconnect coupling for a heavy-duty machine to enable the quick coupling and decoupling of coupling members on a boom and a stick having a tool so that the machine may be easily used for sticks having different working tools, and more particularly to a power coupling having coupling elements carried by the coupling members for connecting a source of power from the machine to the stick that facilitates the proper mating of the coupling elements when the coupling members of the stick and boom are brought into engaging relation.

BACKGROUND OF THE INVENTION

Heretofore, it has been well known to provide a quick connect and disconnect coupling between the boom of a heavy duty machine and a stick, as described in U.S. Pat. Nos. 4,938,651; 5,108,252 and 5,484,250. These prior known coupling members include the use of quick connect/disconnect coupling elements for connecting a power source from the boom to a power device on the stick. However, problems, such as the breaking and/or blowing of seals in hydraulic fluid coupling elements leading to hydraulic fluid leakage and pressure loss, sometimes resulted from the rigid mounting of the connecting coupling elements and the inability of the elements to properly align and couple and decouple. Additionally, even if the seals remained intact, a substantial amount of fluid may be lost in the coupling and uncoupling process of the coupling elements. Moreover, damage to any coupling elements often occurred during the coupling operation.

Further, due to sun exposure, the coupling elements and hydraulic lines may experience a thermal buildup, or an increase in pressure when hydraulic fluid is used. Heretofore, it has been known to use diverter valves in an attempt to accommodate such surges in pressure during the coupling of power coupling elements between the boom of a heavy-duty machine and a stick to minimize fluid loss. However, diverter valves require a mechanical operation with a specific tool and are not always reliable during coupling and uncoupling operations.

SUMMARY OF THE INVENTION

The power coupling of the present invention is an improvement over the above referred to prior known couplers to minimize the problems of losing hydraulic fluid when coupling and decoupling hydraulic coupling elements, and damage to any coupling elements during the coupling and uncoupling operations. In particular, the power coupling of the invention includes one coupling element mounted in an oversized hole of a mounting plate to allow orbital movement on the plate of one coupling member along X and Y axes, and the other coupling element gimbal-mounted on a plate of the other coupling member along a Z axis to facilitate the proper alignment between the power coupling elements when the coupling members are brought together. Thus, the coupling elements are mounted to accommodate X, Y and Z alignment when the elements are coupled and decoupled. Further, bumpers are provided in the mounting structure of the elements to compensate for wear of the coupler member engaging faces, and adjustment along the Z axis. Still further, the present invention includes an accumulator for the hydraulic lines to accommodate any surge pressure generated during the coupling and decoupling operations. The X, Y and Z alignment capability and the accumulator facilitate coupling and decoupling under high pressure and eliminate the need for a diverter valve.

It is therefore an object of the present invention to provide a new and improved quick-disconnect power coupler with coupling members between a boom of a heavy-duty machine and a stick having power coupling element mountings to substantially eliminate power coupling element damage and/or spillage of hydraulic fluid.

A further object of the present invention is to provide a new and improved power coupling for a quick-disconnect coupling that utilizes a gimbal-mounted power coupling element on one coupling member for Z axis alignment and a coupling element mounted on the other coupling member in an oversized hole of a plate on the other coupling member for X and Y axes alignment to allow for the coupling elements to move relative to one another during coupling and decoupling to assist in the proper engagement of the coupling elements and avoid loss of hydraulic fluid.

Another object of the present invention is to provide a hydraulic power coupling for a quick-disconnect coupling mounted for X, Y and Z alignment that minimizes or eliminates the loss of hydraulic fluid during the coupling and uncoupling operations.

Still another object of the present invention is to provide mountings for power coupling elements that compensate for wear between coupler faces.

Yet another object of the present invention is to provide hydraulic coupling elements that accommodate surges of hydraulic pressure during the coupling and decoupling process, thereby substantially eliminating spillage of hydraulic fluid.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
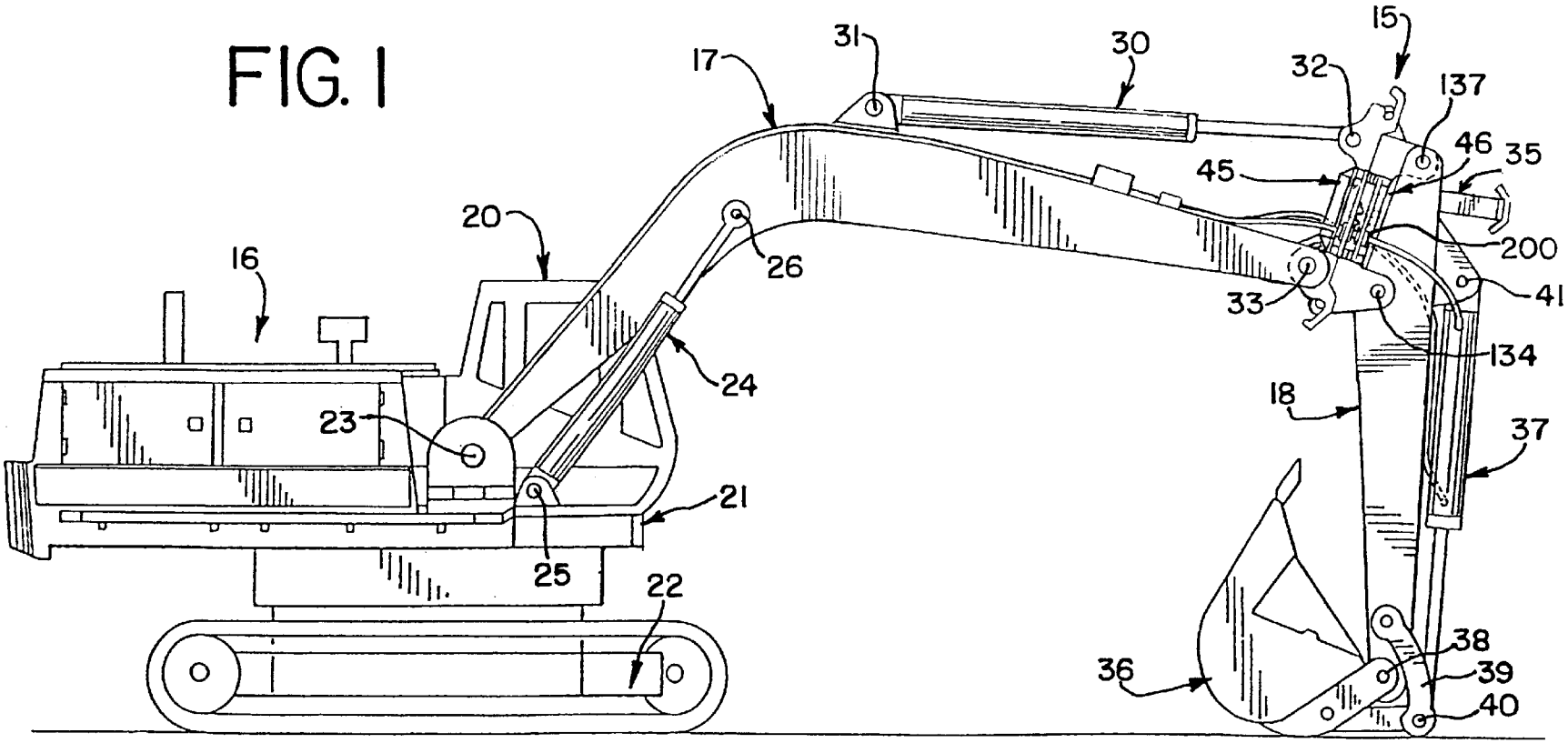
FIG. 1 is a side elevational view of a heavy-duty machine having a boom that is connected by a quick-disconnect coupling of the present invention to a stick having a tool and showing the power coupling of the present invention.
Figure 2:
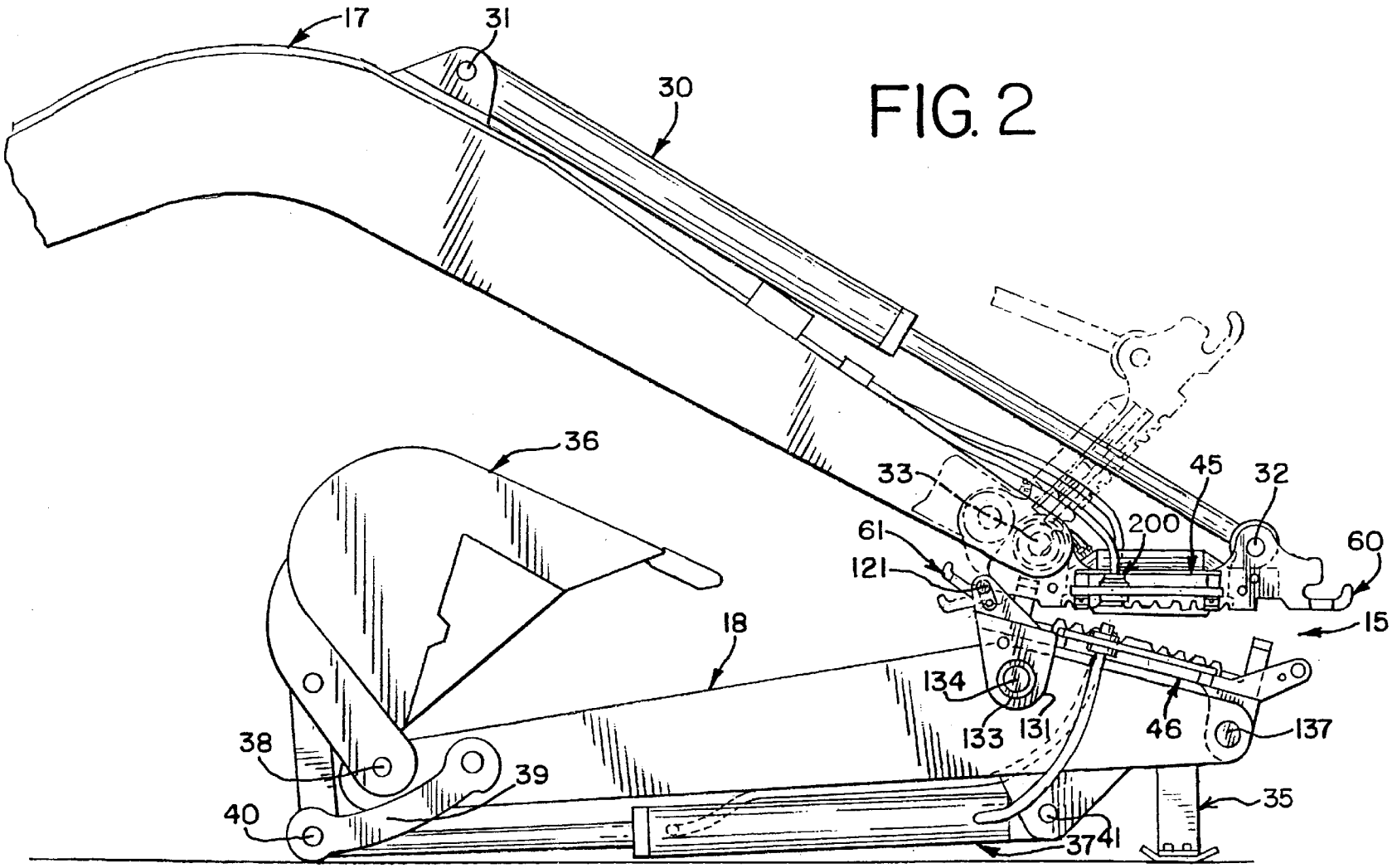
FIG. 2 is an enlarged side elevational view of the stick lying horizontally on the ground and being supported by a stand beneath a fragmentary side elevational view of the boom to illustrate the manner in which the coupling members are brought together when the grabber of the male coupling member is used and illustrating the angular relationship of the coupling members during the coupling process.
Figure 3:
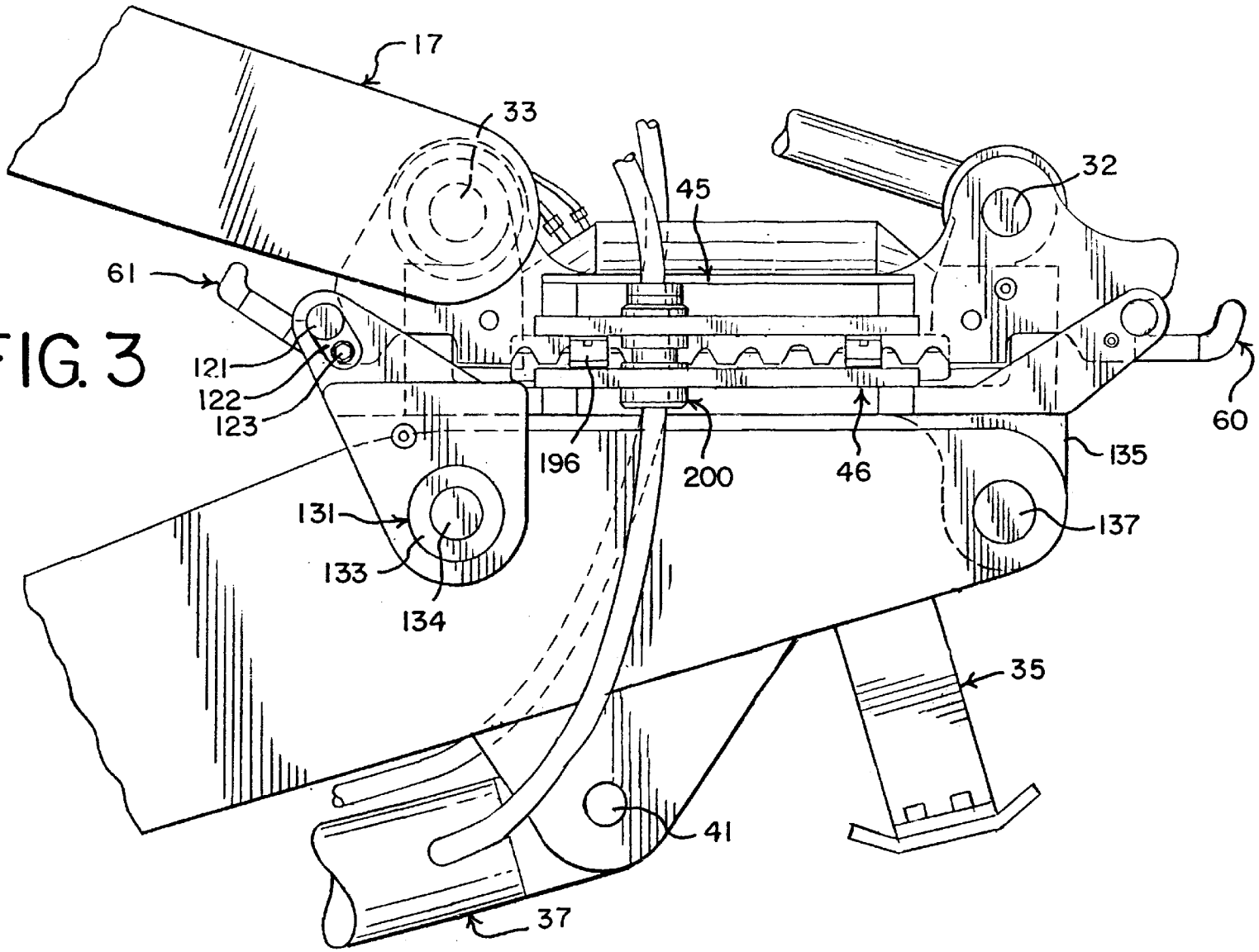
FIG. 3 is a fragmentary enlarged side elevational view of the coupled quick-disconnect coupling and showing the hydraulic coupling elements in coupled relation.

Referring now to the drawings, and particularly to FIGS. 1 to 3, the improved power coupling of the present invention, generally designated by the numeral 200, is illustrated on a heavy-duty machine 16 having a boom 17 and a stick 18 with a hydraulically operated bucket tool thereon. The stick 18 and boom 17 are connected by a quick-disconnect coupling 15 that is constructed for use on any heavy-duty machine having a boom for quick interchangeability of sticks having various tools or working members. The heavy-duty machine includes a cab or operator station 20 on a carriage or base 21 which in turn is rotatably supported on a track drive 22. While the invention is shown on a heavy-duty machine having a boom and a stick, it is appreciated that it may be used on other heavy-duty machines, such as farm equipment, an excavator, a back-hoe, or any other heavy-duty machinery where it is desired to have the capability of interexchanging tools..

The boom 17 is pivotally connected at one end to the machine at 23 and articulated in a vertical direction by means of a double-acting hydraulic cylinder 24 pivotally connected at one end at 25 to the machine base 21 and pivotally connected at the other end to the boom 17 at 26 in a known manner. Thus, operation of the hydraulic cylinder 24 swings the boom vertically up or down.

The boom 17 also includes on its upper side a stick cylinder pivotally connected to the boom 17 at one end at 31 and pivotally connected at the other end to the coupling 15 at 32. The coupling is pivotally connected to the end of the boom at 33.

The stick 18 includes a bucket 36 and a double-acting bucket cylinder 37. The bucket is pivotally connected to the end of the stick 18 at 38 and includes linkage 39 which is pivotally connected to one end of the cylinder 37 at 40. The other end of the cylinder 37 is pivotally connected to the upper end of the stick 18 at 41. A stand 35 is mounted on the coupling end of the stick and on the bucket operating cylinder side to provide support for the coupling end when the stick is placed on the ground as shown in FIG. 2, and as disclosed in my copending application Ser. No. 09/627,339, filed Jul. 28, 2000.

Figure 6:
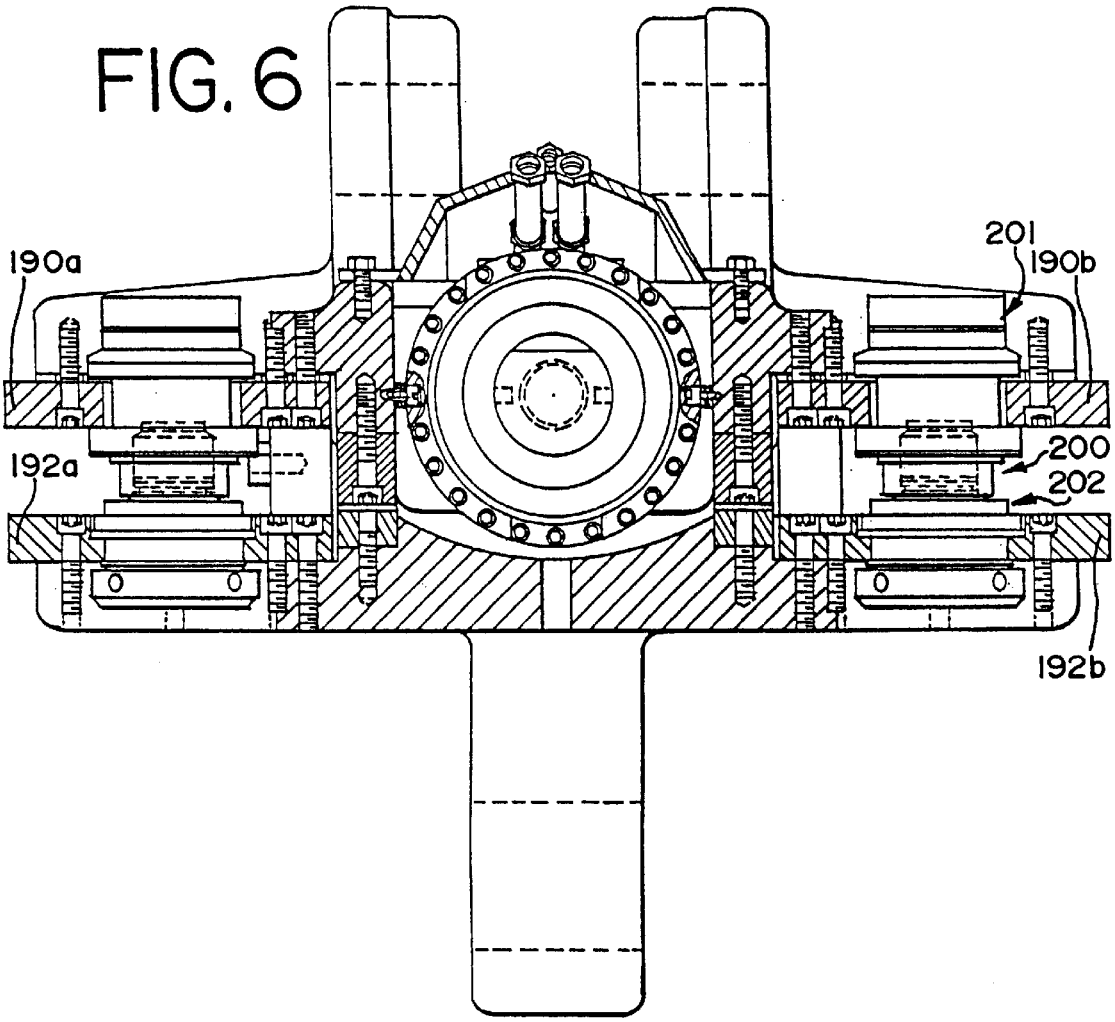
FIG. 6 is a transverse sectional view of the male and female coupling members in coupled relation and showing the male and female hydraulic coupling elements in mated position with part of the male coupling element shown in phantom.

For purposes of simplicity, not all of the various hydraulic lines are illustrated in the drawings for the hydraulic cylinders and for connecting the hydraulic power source generated by the machine. As seen in FIGS. 3 and 6, a protector hood is provided on the male coupling member to protect the hydraulic lines against damage during handling. Further, it should be appreciated that while a stick and boom is shown with a hydraulic coupling, other types of couplings, such as suction, pneumatic or electric, can be used with the present invention. It should also be appreciated that while the stick is shown as including a bucket as the working tool, other sticks having other working tools may be provided with female coupling members to be interchangeable so that the heavy-duty machine may serve to easily accomplish different working functions.

The coupling 15 preferably includes a male coupling member 45 pivotally connected to the boom 17 at pivot 33 and stick cylinder 30 at 32 and a female coupling member 46 mountable on the stick 18. However, the female coupling member 46 may be suitably connected to the boom 17 and the stick cylinder 30 and the male coupling member 45 may be suitably mounted on the stick 18.

Figure 4:
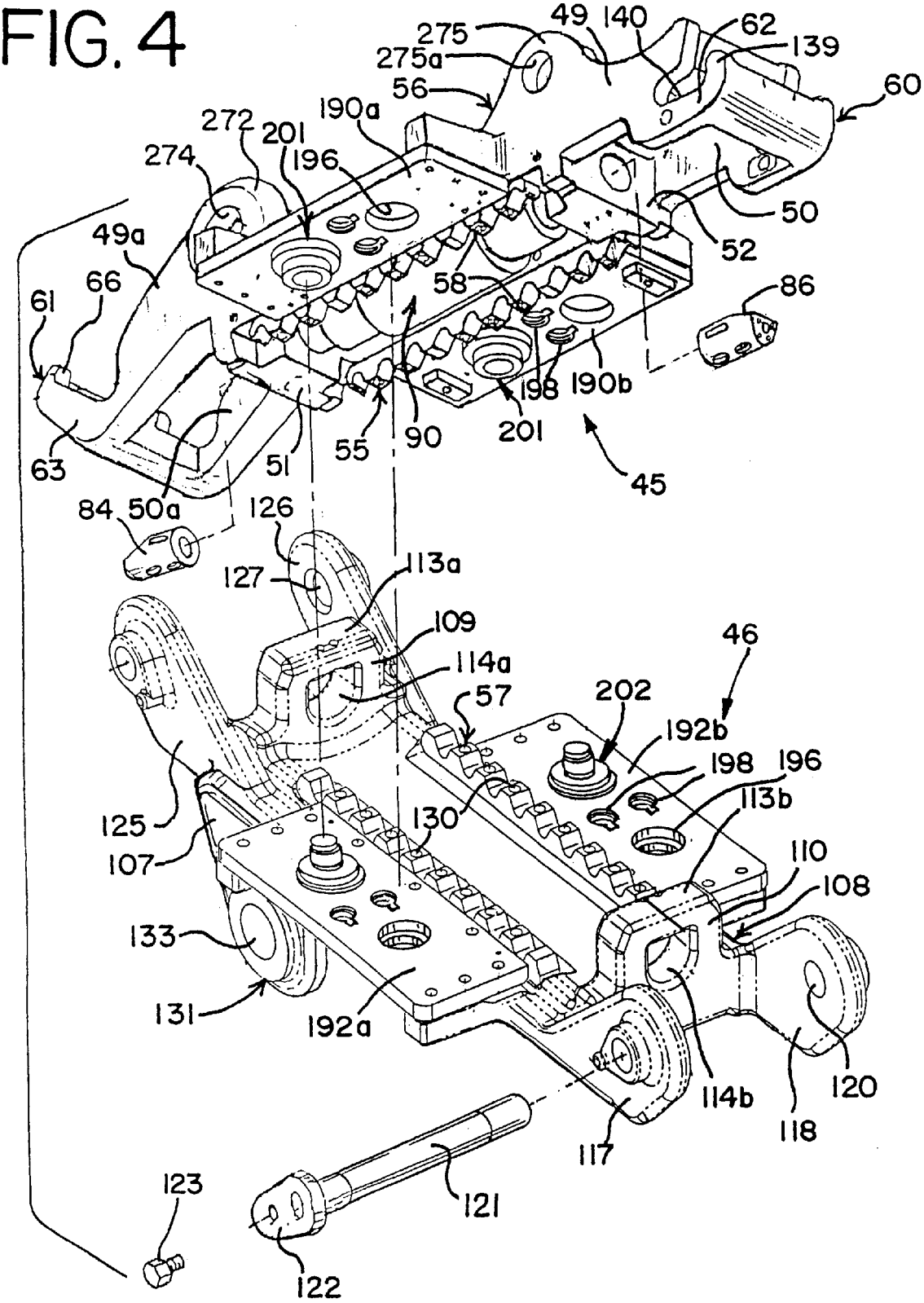
FIG. 4 is an exploded perspective view of the male and female coupling members of the quick-disconnect coupling and showing the power coupling elements.

As particularly seen in FIG. 4, the female coupling member 46 includes two parallel and elongated side rails 107 and 108 that are spaced apart and interconnected at opposite ends by transversely extending end plates 109 and 110. At the opposite ends of end plates 109 and 110, teeth 113*a* and 113*b* extend transversely to interengage in tooth sockets on the male coupling member formed by frame side plates 49 and 50 on the picker end and 49*a* and 50*b* on the grabber end to control lateral movement between the coupling members. Further, these tooth-shaped sections include sockets 114*a* and 114*b* for slidably receiving and guiding the wedge-shaped bars 84 and 86 of the locking mechanism 90 on the male coupling member.

At the top or head end of the female coupling member, arms 117 and 118 extend upwardly from and at an angle to the side plates 107 and 108 and are provided with aligned holes 120 for selectively receiving the pin 121 that coacts with the picker 60 during the initial guiding together of the male and female members during a picker coupling operation.

The pin is preferably in the form of a roller pin and includes a retaining plate or lug 122 fixed at one end engaging the outside surface of the arm 117 and attachable to the arm by a bolt 123, as seen in FIG. 3. The roller pin decreases the amount of wear on the pin and the male coupling member and facilitates the action of joining the coupling members during the coupling operation and separating the members during the decoupling operation, as disclosed in my above-mentioned copending application.

Alternatively, if it is desired to utilize the grabber 61 to accomplish the initial alignment for a grabber coupling operation, the pin may be placed within the pin holes 127 of the extending arms 125 and 126 at the toe end of the female member. Thus, the pin 121 is interchangeably mountable at either end of the female member depending on whether the picker 60 or the grabber 61 is to be used during coupling operation to bring the coupling members together, as disclosed in my above-mentioned copending application.

Between the female member side rails 107 and 108 on the female coupling member are two parallel rows of gear teeth 130 that mate with the gear teeth 58 of the male member during coupling of the members. The engaging faces of the gear teeth together with the engagement of the teeth 113 in the tooth sockets on the male member preclude any sliding action between the coupler members.

The female coupling member illustrated includes pin bosses for pin-connecting the female member to a stick having the standard pin holes. At the underside of the side plates 107 and 108 and the toe end of the female coupling member, a pair of pin bosses 131 with aligned pin openings 133 are provided for pin-connection of the toe end of the female coupling member to the stick by means of a pin 134 as seen particularly in FIGS. 1 to 3. At the head end of the female member, a single pin boss 135 is provided and centered so that it can fit between a bifurcated end of the stick. An eccentric bushing (not shown) having a pin hole may be received in the pin poss 135 and adjustably rotated within a circular bore in order to compensate for minor spacing and/or misalignment differences that may occur in different sticks between the pin hole boss and a pin 137 that is provided to pin-connect the pin boss to the outer end of the stick.

It should be appreciated that the female member could be formed for direct welding or bolting to a stick. One way to weld the female coupling member to the stick would be to cut back part of the end of the stick and eliminate the pin bosses on the female coupling member such that the end of the stick and the underside of the female coupling member were substantially flat. The underside of the female coupling member may also have a wall shaped as a box to facilitate the welding process.

The parallel spaced-apart side frame plates 49 and 50 of the male coupling member 45 are connected together near their opposite ends by end walls 51 and 52, as seen in FIG. 4. It will be appreciated that the entire coupling is made of a suitable steel and that the thickness of the plates and end walls is such that they constitute a frame that will withstand all of the forces subjected to the coupling member during the use of the coupling by the heavy-duty machine. The side frame plates include a mating face 55 and a backside 56. A series of teeth 58 are provided along the edges of plates 49 and 50 that mate with teeth on the female coupling member. These teeth are preferably in the form of gear teeth and take the appearance of a rack gear at each side of the coupling member. The mating face 55 is adapted to mate with the mating face 57 of the female member 46.

At the toe end of the male member and also at the backside, pin bosses 272 are provided at each side plate for the purpose of providing pin holes 274 that coact with pin holes on the free end of the boom 17 to receive the pin 33 for pin-connecting the lower or toe end of the male member to the end of the boom so that the lower end of the male member can pivotally swing in a vertical direction relative to the end of the boom.

Also on the backside of the male member and its upper or head end, pin bosses 275 are provided on the inner sides of plates 49 and 50 to define pin holes 275*a* for coacting with pin 32 to interconnect the piston rod of the stick cylinder 30 to the upper or head end of the male member whereby actuation of the cylinder will cause pivotal swinging of the male member in a vertical plane.

The male coupling member includes at the upper or head end a picker 60 and at the lower or toe end a grabber 61, each of which may guidably assist in bringing together the coupling members during the coupling operation depending on which end is desired to be used during the coupling and which end of the female member includes the pin 121.

The picker 60 includes a pair of parallel flat body sections or arms 62 interconnected at their ends and formed as a hook 139 for facilitating the placement of the pin 121 within cavities or slots 140 when the coupling members are coupled.

The grabber 61 is mounted at the toe end of the male member to assist in guidably interconnecting the male and female members when the pin on the female member is located at the toe end of the female member. As seen in FIG. 4, the end of the grabber 61 is formed at 63 in the form of a hook that receives the pin of the female member and positions the respective ends of the coupling members so as the members come together in an angular relation, the intermeshing elements of each member may matingly engage. Additionally, the hook on the grabber may taper upwards to define a retaining wall 66 to maintain the pin within the grabber during engagement. Preferably, the height of the retaining wall is at least equal to the radius of the pin.

While not shown, latching members may be provided at the picker and grabber ends to latch the female member pin to the male coupling member during the coupling and uncoupling process, as disclosed in my above-mentioned copending application. Both latching members will be simultaneously actuated even though only one of the members will be used depending on the end having the pin.

Figure 5:
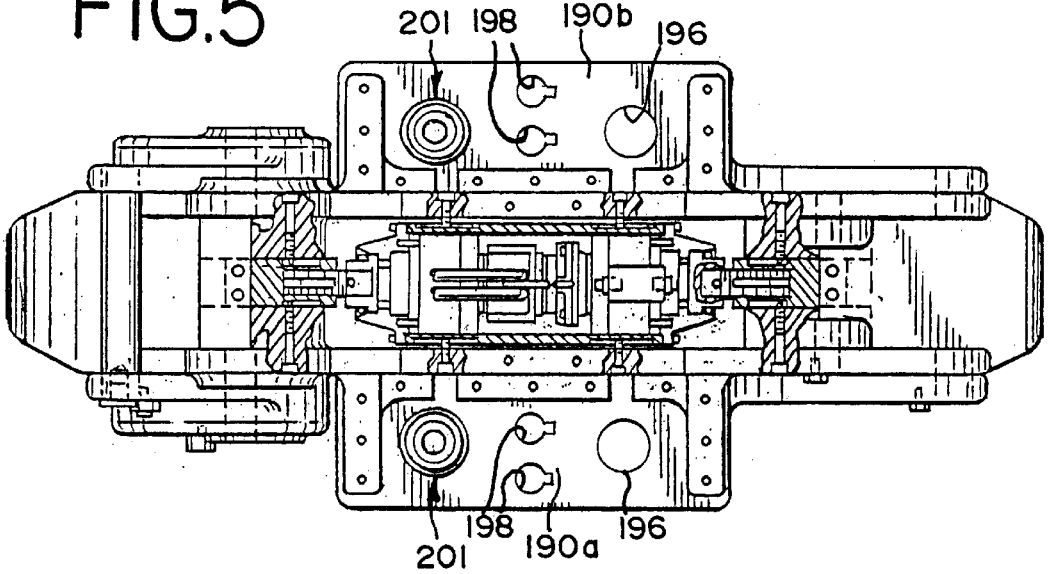
FIG. 5 is a bottom plan view of the male coupling member showing a pair of support plates fitted with hydraulic coupling elements and holes for electric power coupling elements.

Referring now to FIGS. 5 and 6, power coupling mounting plates 190*a* and 190*b* extend laterally from the male coupling member 45 and mounting plates 192*a* and 192*b* extend laterally from the female coupling member 46 for purposes of receiving suitable power coupling elements such as hydraulic fluid fittings of which a male coupling element and a female coupling element comprise a power coupling. While a pair of hydraulic couplings 200 are shown on the plates 190*a* and 192*a* to serve a single double-acting cylinder, it will be appreciated that any number of hydraulic couplings may be provided in order to properly handle whatever hydraulic cylinders are provided on the stick. Further, it will be appreciated that other types of power couplings may be mounted on the plates. The quick-disconnect hydraulic coupling 200 includes a male coupling element 202 and a female coupling element 201.

The power coupling mounting plates or brackets 190*a* and 190*b* and 192*a* and 192*b*, have a series of holes 196 and 198 for receiving power coupling elements. Holes 196 are sized to generally receive hydraulic coupling elements and suction coupling elements and holes 198 are sized to generally receive lower pressure hydraulic coupling elements, pneumatic coupling elements, or electrical coupling elements. It may be appreciated that the holes may be made of any size to receive power couplings of various sizes and types. As seen in FIGS. 4 and 5, the holes 198 have a slot to orient an electrical power coupling. Also, while each plate is shown with two holes for hydraulic coupling elements and two holes for electrical, hydraulic and pneumatic coupling elements, it may be appreciated that the plates could have any number of holes to accommodate the particular power requirements of a given stick and tool.

Although the male and female power coupling elements may be mounted on either of the plates 190*a* and 190*b* or 192*a* and 192*b* preferably the female coupling elements will be mounted on plates 190*a* and 190*b* of the boom coupling member because the coupling elements on the boom, when uncoupled, are normally stored facing downwardly while the coupling elements on the stick are normally facing upwardly. Thus, the collection of debris in the female coupling elements is minimized.

Figure 7:
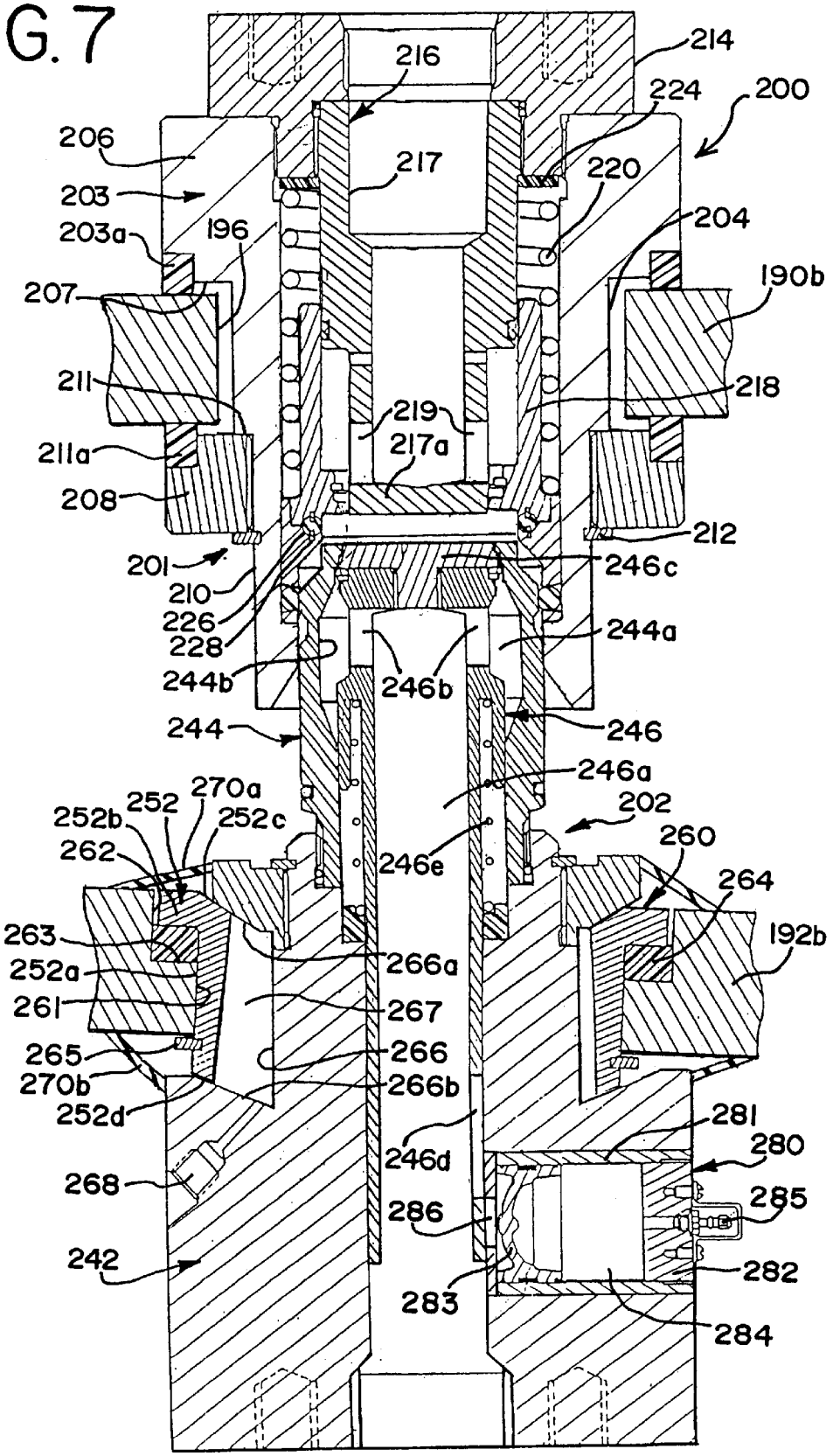
FIG. 7 is an enlarged vertical sectional view of a hydraulic coupling according to the invention on the coupling mounting plates of coupling members showing the hydraulic coupling elements initially mating with the male coupling element tilted at an angle along the Z axis in its gimbal mounting as it begins to engage the female coupling element.
Figure 8:
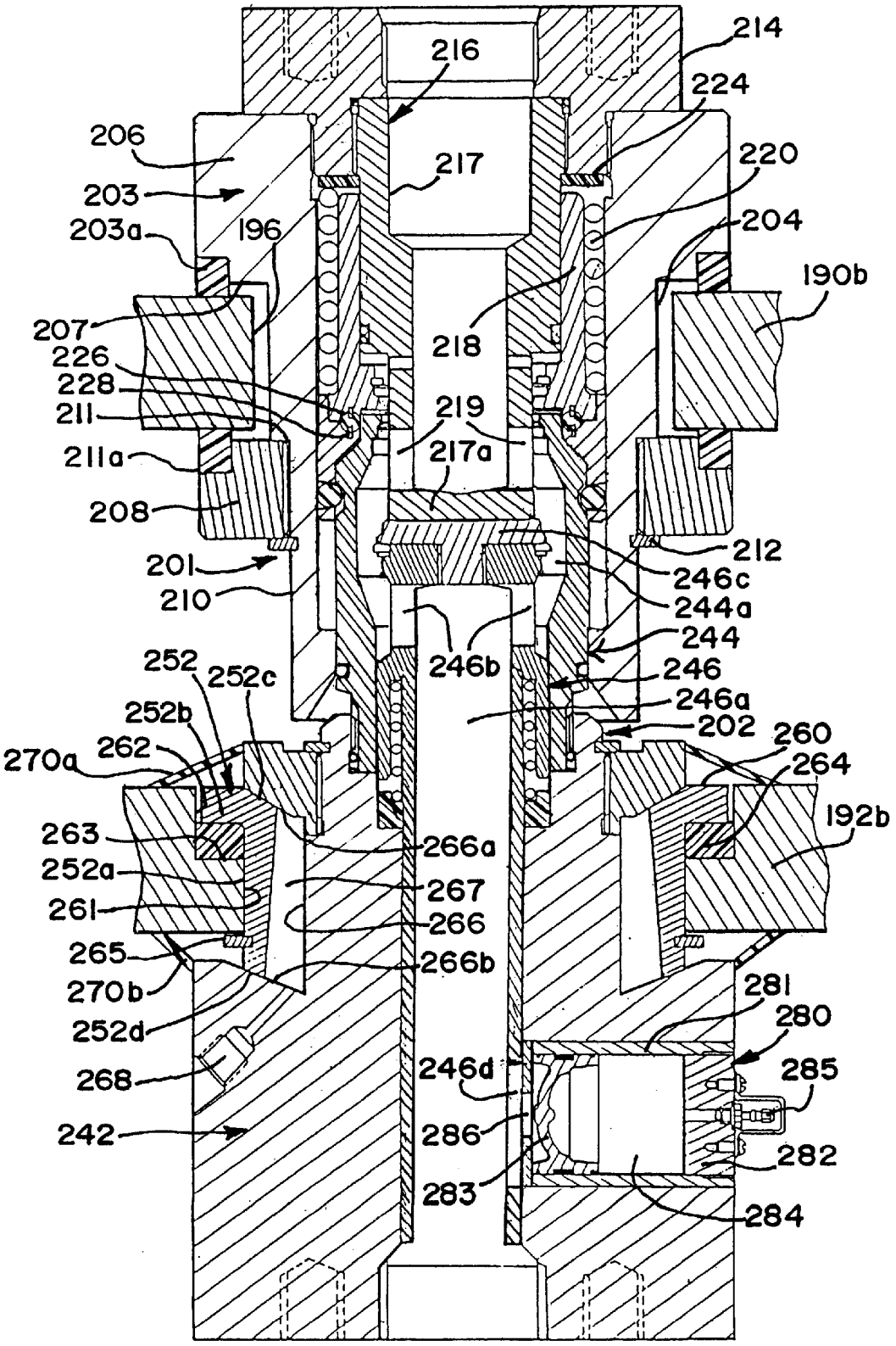
FIG. 8 is a sectional view like FIG. 7 showing the hydraulic coupling elements and the coupling members in fully coupled relation.

Referring to the detailed sectional views of FIGS. 7 and 8, one of the hydraulic couplings 200 is shown and will be described as mounted on the boom mounting plate 190*b*. FIG. 7 shows the coupling elements in the initial stage of coupling with the male and female coupling members in non-parallel relation to each other as they begin to couple, where the male coupling element 202 is tilted in its gimbal mount along the Z axis to align with the female coupling element. Because of the angular mating of the coupling members, the mountings of the power coupling elements according to the invention accommodate the alignment of the elements to avoid hydraulic fluid loss and damage to the elements. FIG. 8 shows the mounting plates of the coupling members in parallel relationship and the male coupling element disposed in perpendicular relation to its mounting plate when the coupling members and elements are in fully coupled relationship.

As seen in FIG. 7, the female coupling element 201 includes a tubular body 203 having an exterior cylindrical face 204 sized smaller than the mounting plate hole 196 on the boom mounting plate to allow 360 degrees lateral sliding or orbital movement of the element on the mounting plate along the X and Y axis. Thus, the hole 196 is oversized to the coupling element 201 to permit the orbital movement of the element on the plate 190*b*. This mounting for the female element allows the element to be repositioned on the mounting plate to facilitate alignment and mating with the male element as the coupling members come together, and avoid damage to the elements. Where the elements are of the hydraulic type for joining hydraulic lines mal-alignment that could cause fluid spillage is avoided. A diametrically enlarged portion 206 is sized larger than the hole and defines a shoulder 207 overlying the mounting plate. An annular plastic bearing 203*a* of self-lubricating plastic is carried at the shoulder 207 for enhancing the sliding relation between the plate and element body. A nut 208 is threadedly received on a cylindrical face 210 of the body that is diametrically reduced from the exterior face 204 to retain the female coupling element on the plate 190. The bearings 203*a* and 211*a* also serve as bumpers and having some compressibility to compensate for wear on the faces of the coupling members to adjust the relation of the coupling members along the Z axis. The nut defines an annular shoulder 211 having an annular self-lubricating bearing 211*a* engaging the underside of the mounting plate 190. A snap ring 212 is provided to lock the nut in place.

A coupling adaptor 214 is threadedly secured to the diametrically enlarged portion 206 of the tubular body 203, which is at the boom side end of the female coupling element. This adaptor is provided with tapped holes for receiving bolts to secure a hydraulic line connecting flange, such as the split flange disclosed in Stafford U.S. Pat. No. 3,600,012, to allow the coupling element to be connected to a hydraulic line. By varying the size of the adaptor 214, including the addition of a further adapter screw threaded to the interior threaded area of the adaptor, various sizes of hydraulic lines with various bolt hole configurations may therefore be used with the hydraulic coupling elements. The internally threaded bore can also directly receive a threaded hydraulic line fitting.

A tubular fluid shaft 216 is threadedly connected to the adaptor 214 and having a stepped channel or passageway 217 open at the adaptor end and closed by an end wall 217*a* at the other end to define a stop for abutting the end of the barrel valve of the male coupling element as described hereafter. Coupling orifices 219 are provided in the shaft 216 and are closed by a sliding sleeve or valve plate 218 slidably carried on the shaft 216 and normally maintained in closed position by a spring 220 to prevent any flow or leakage of hydraulic fluid when the female coupling element is not coupled. A plastic bumper or washer 224 is provided between one end of the spring and the lower end of the adaptor 214 to compensate for any tolerances in the axial direction when the coupling elements are mated. The bumper is preferably made of urethane, although it is appreciated that it may be made of any suitable material.

The sliding sleeve 218 is preferably a two-piece sleeve having upper and lower pieces threadedly connected together, although it can be appreciated that it could be made as a one-piece sleeve. The threadedly connected together two-piece construction allows machining of the mating pieces for receiving and locking an annular seal 226 to the sleeve to prevent the seal 226 from being vacuumed into the coupling by the hydraulic fluid forces during the coupling and decoupling operations. In particular, the seal 226 is in the form of a quad seal comprising a 90 durometer resilient material bonded to diametrically opposed metal rings 228. The metal rings or the wings on the plastic seal mate with slots machined in the coacting pieces of the sliding sleeve to firmly maintain the seal in place. As shown in FIG. 8, the seal 226 seals the upper end of the barrel valve of the male element to the sliding sleeve 218. Alternatively, the seal 226 may be in the form of a standard O-ring type seal that is held in place by the groove which is formed by defining a groove that covers all but a portion of the seal to prevent the seal from escaping from the groove, and only removable by separation of the two-piece sleeve. Thus, the two-piece sleeve would collectively define an annular groove having a generally cylindrical cross section with an annular slot to allow the seal to protrude and engage the shaft. The seal would only be removable by separating the two-piece sleeve.

The male coupling element 202 includes a coupling body 242 gimbally mounted in the mounting plate 192 of the female coupling member. A tubular nipple 244 is threadedly connected to the body 242, and within which a barrel valve 246 having an axially extending fluid passageway or channel 246*a* communicating with the hydraulic line connected to the body 242 from the stick. Similar to the female coupling adaptor 214, the end of the body 242 opposite the nipple end includes tapped holes for attaching a flanged hydraulic line, and internal threading for attaching a threaded fitting on the end of a line. The upper end of the barrel valve 246 is closed by an end wall 246*c*. An annular connecting chamber 224*a* is defined by an internal cutaway portion of the tubular nipple 244 for connecting ports 219 and 246*b* on the female and male coupling elements when they are mated together. As seen in FIG. 8, the chamber overlaps the connecting ports of both elements. The outer face of the nipple is shaped to conform to the inner face of the sliding sleeve 218 and to drive the sleeve 218 to open the ports 219 when the ports 246*b* are being opened to provide a hydraulic fluid connection between the boom line and the stick line.

The barrel valve 246 is resiliently biased to the position shown in FIG. 7 by a spring 246*e* where the upper end or cap 246*c* is seated against a shoulder at the upper end of the nipple 244 to close the nipple.

As shown in FIGS. 7 and 8, the male coupling element 202 is gimbally mounted to allow it to freely tilt on the plate 192*b* along the Z axis to coact with the slidable mounting of the female coupling element and facilitate the proper mating of the coupling elements when the coupling members are brought into engagement. The gimbal mount includes an annular gimbal bushing or ring 246*e* received in a stepped opening of the plate 192*b* and which includes an annular wall 261, a larger annular wall 262, and an annular shoulder 263 between the walls 261 and 262. The gimbal bushing 252 matingly fits in the stepped opening where its outer surface 252*a* mates with the smaller annular wall 261 of the plate 192. An outwardly projecting annular lip 252*b* coacts with an annular plastic bearing or bumper 264 to rest on the shoulder 263 of the opening. A snap ring 265 engages in an annular groove on the bushing 252 and underlies the under surface of the plate 192*b* to lock the bushing to the plate. The bumper 264 is also somewhat compressible like bumpers 203*a* and 211*a* to provide compensation for wear of the engaging faces of the coupling members and adjustment along the Z axis. The coupling body 242 includes an outer annular groove 266 having inclined upper and lower gimbal bearing surfaces 266*a* and 266*b* that bearingly engage upper and lower inclined bushing bearing surfaces 252*c* and 252*d*. The gimbal bearing surface 266*a* is formed on an annular ring mounted on the body 242 by fitting over the upper end of the body. Preferably, the ring is threadedly mounted on the body and held in place by a snap ring. The gimbal groove 266 is sized to coact with the gimbal bushing 252 to define a lubrication channel 267 in which grease is pumped through a grease fitting 268 to lubricate the gimbal bearing surfaces. In order to protect the gimbal bearing surfaces against dirt and debris, upper and lower resilient boots 270*a* and 270*b* are suitably attached to the mounting plate 192 and coupling body. Accordingly, the male coupling element is gimbal-mounted to the mounting plate 192 for tilting in any direction off the Z axis during coupling and uncoupling with the female coupling element, thereby properly allowing the valve members on the coupling elements to open and close and essentially eliminate fluid spillage and damage to the coupling elements. Therefore, the combination of the oversize hole 196 on the plate 190*b* of one coupling member for receiving the female coupling element of the power coupling and the gimbal mounting of the male coupling element on the other coupling member enables the X, Y and Z alignment capabilities of the power coupling. Additionally, the bumpers compensate for wear on the engaging faces of the coupling members so that the power coupling elements will properly mate to substantially eliminate loss of hydraulic fluid during coupling and uncoupling operations. Additionally, the bumpers absorb shock during the coupling operation.

In order to accommodate hydraulic pressure surges during coupling and uncoupling of the male and female coupling elements, an accumulator 280 is built into the coupling adaptor 246. Normally, hydraulic pressure within the coupling elements and their associated lines is between 4500 and 5000 psi. Preferably, the accumulator is pressurized at a higher pressure, such as 5500 psi, so that pressure surges above line pressure can be handled by the accumulator. Therefore, a surge in pressure above the normal line pressure can be accommodated by the accumulator in order to minimize, if not eliminate, spillage of the hydraulic fluid during the coupling and/or uncoupling process.

The accumulator 280 includes a cylindrical casing or sleeve 281 closed at one end by a cap 282 and within which a piston 283 is slidably received. A pressure chamber 284 is defined between the piston and the end cap 282 that can be selectively pressured with a suitable gas through a valve 285. Preferably, the accumulator in chamber 284 is filled with compressed nitrogen gas, although any suitable non-inflammable inert gas may be employed. A port 286 is provided on the non-pressure side of the piston to selectively communicate with the hydraulic fluid carrying channel within the male coupling element as the barrel valve 246 is driven into the male coupling element during complete mating engagement of the male and female coupling elements. As seen in FIG. 8, a port 246*d* is provided in the barrel valve 246 which communicates with the port 286 of the accumulator 280 as the barrel valve is initially driven into the male coupling element when the coupling elements come together. Otherwise, when the male coupling element is in uncoupled mode, the barrel valve blocks the port 286. Thus, when the mating of the male and female elements begin an opening is provided between the fluid channel of the male coupling element and non-pressure side of the accumulator piston 283 to allow pressure surges to be accommodated by the accumulator. A pressure surge will drive the piston toward the end cap 282, thereby compressing the gas in the accumulator chamber 284 and define an expansion area for the hydraulic fluid within the casing 281 of the accumulator. Once the pressure in the coupling element fluid passageway diminishes below the pressure in the accumulator chamber 284, the piston is driven toward the coupling element fluid passageway by the pressurized gas to return any hydraulic fluid into the passageway.

It should be appreciated that the accumulator may be provided in the female coupling element if so desired, or that accumulators may be provided in both coupling elements. Moreover, it may be appreciated that the barrel valve which normally closes off the accumulator port need not be provided to do so inasmuch as the pressure in the accumulator is higher than that normally expected in the hydraulic lines and coupling elements. Further, it should be appreciated that while a piston type accumulator is shown in the drawings, any suitable accumulator may be provided, including a bladder-type accumulator.

In operation, when the picker or grabber on the male coupling member is used to pick up the stick, the pin 121 on the female coupling member 46 is engaged to begin the coupling process by maneuvering the boom such that the pin will be completely engaged by either the picker or grabber. At this point, the coupling members are angularly related to each other as shown in FIG. 2 where the picker is in engagement with the pin on the female coupling member. Once the pin is properly engaged, the male and female coupling members 45 and 46, and thereby the male and female coupling elements 201 and 202, upon manipulation of the boom may be brought together for mating. If the male and female coupling elements 201 and 202 are not initially aligned to go straight together, the oversized hole mounting arrangements for the female power coupling elements will allow the female coupling elements to move laterally along the X and Y axes or a combination of these axes on their mounting plates 190*a* and 190*b* and the gimbals on the mounting plates 192*a* and 192*b* for the male coupling elements will allow the male elements to tilt about the Z axis so that all of the elements will become aligned as shown in FIG. 7, and the coupling elements can thereafter properly mate as they come into coupled relation. Thus, the female coupling elements are capable of moving radially in any direction to adjust their position on the coupler member mounting plate for proper engagement of the male coupling elements.

The male coupling element will continue entering the female member until the cap 246*a* on the barrel valve 246 of the male element engages the cap 217*a* of the tube 216 on the female element. As the elements continue to come together, the tube and cap will drive the barrel valve 246 into the male element nipple 244, thereby compressing the spring 246*e* and opening the fluid communication for the male coupling element. Generally, at the same time nipple 244 will bias the sliding sleeve 218 into the female element, thereby compressing the spring 220 to open fluid communication for the female coupling element and allow fluid to flow between the coupling elements. As shown in FIG. 8, when fully mated, the inner wall 244*b* of the nipple 244 will coact with the shaft 216 and the valve 246 to form the passageway 224*a* between ports or orifices 219 of the female coupling element and ports or orifices 246*b* of the male coupling element to allow hydraulic fluid to flow from the boom to the stick for selectively operating the stick tool. When the coupling is decoupled, the coupling elements will begin separating. As the coupling elements separate, spring 220 will bias the sliding sleeve 218 on the female power element such that it once again closes off the orifices 219 to block fluid flow from the power side of the boom, as seen in FIG. 7. Further, the barrel valve 244 will be biased to closed position to close off the ports 246*b*. So, as the coupling elements separate, they close off the respective hydraulic lines to prevent fluid loss. Also, the male element is free to tilt in its gimbal mount on the plate 192 and allow clean disengagement of the male and female elements.

With respect to mounting systems of the power couplings for vacuum and electrical power, the mounting structure of the female and male coupling elements will be essentially like the herein described hydraulic couplings in that the female coupling element will be capable of alignment on its mounting plate along the X and Y axes, while the male coupling element will be capable of tilting on the Z axis. Further, bumpers will likewise compensate for coupler member wear.

It will be understood that modifications and variations may be effected without departing from the scope of the novel concepts of the present invention, but it is understood that this application is limited only by the scope of the appended claims.

The invention is hereby claimed as follows:

1. In a heavy-duty machine for performing work including a ground-supporting base having an operator station, a boom pivotally mounted on one end to the base, a stick pivotally mounted to the free end of the boom to swing vertically relative to the boom, a working tool mounted on the free end of the stick, at least one power line extending from the stick, at least one power line on the boom for connecting to the power line on the stick, means for driving the boom and the stick, a quick-disconnect coupling between the boom and stick to permit a quick interchange of sticks which includes means to pivotally connect the stick to the boom, wherein the quick-disconnect coupling includes a male coupling member pivotally mounted on the boom and a female coupling member mounted on the stick, means on said coupling members defining engaging faces that prevent sliding movement between the faces, means on said coupling members for pivotally connecting the members at one of their ends and swinging the other of their ends toward each other until the members are folly engaged, a power coupling including a male power coupling element and a female power coupling element for connecting the power lines of the stick and boom, one of the power coupling elements mounted on the male coupling member and connected to the boom power line and the other of said elements mounted on the female coupling member and connected to the stick power line such that when the coupling members are brought together in engaging relation the power coupling elements will couple to connect the power lines, the improvement in means mounting the power coupling elements on the coupling members to permit movement between the coupling elements and the coupling members over the X, Y and Z axes for aligning the coupling elements prior to the complete coupling of said coupling members and said coupling elements.

2. The power coupling of claim 1, wherein the power coupling is a hydraulic coupling.

3. The power coupling of claim 1, wherein the power coupling is a pneumatic coupling.

4. The power coupling of claim 1, wherein the power coupling is a suction coupling.

5. The power coupling of claim 1, wherein the power coupling is an electrical coupling.

6. The power coupling of claim 1, wherein the aligning mounting means includes a gimbal mechanism for at least one of the coupling elements.

7. The power coupling of claim 6, wherein the male coupling element includes the gimbal mechanism.

8. The power coupling of claim 6, wherein the female coupling element includes the gimbal mechanism.

9. The power coupling of claim 6, wherein the mounting means further includes an oversized hole on one of the coupling members for receiving at least one of the coupling elements to allow the coupling element to move laterally in any direction during coupling and uncoupling of the power coupling.

10. The power coupling of claim 1, wherein at least one of the coupling elements includes an accumulator to accommodate surges in pressure produced during coupling and decoupling the power coupling.

11. The power coupling of claim 10, wherein the accumulator is included on the male coupling element.

12. The power coupling of claim 10, wherein the accumulator is included on the female coupling element.

13. The power coupling of claim 10, wherein accumulators are provided in both coupling elements.

14. The power coupling of claim 10, wherein the accumulator is a piston type accumulator.

15. The power coupling of claim 10, wherein the accumulator is a bladder type accumulator.

16. The power coupling of claim 1, wherein the female power coupling element is mounted on the boom coupling member and the male power coupling element is mounted on the stick coupling member.

17. The power coupling of claim 1, wherein the male power coupling element is mounted on the boom coupling member and the female power coupling element is mounted on the stick coupling member.

18. The power coupling of claim 1, wherein the means mounting said coupling elements includes compressible bumpers to compensate for wear on the engaging faces of the coupling members and absorb the closing forces of the coupling members.

19. The power coupling of claim 18, wherein the power coupling element mounting means includes plates extending from the coupling members on which the power coupling elements are mounted, and said compressible bumpers are disposed between the elements and the plates.

20. The power coupling of claim 1, wherein the mounting means for the power coupling elements includes plates extending from the coupling members on which the power coupling elements are mounted, one of the plates having an oversized hole for receiving one of the power coupling elements to permit lateral movement of the element in any direction about the X and Y axes, and the other of the plates having gimbal means for the other of the power coupling elements to gimbal mount the element to the plate and coupling member for movement on the plate about the Z axis.

21. In a heavy-duty machine for performing work including a ground-supporting base having an operator station, a boom pivotally mounted on one end to the base, a stick pivotally mounted to the free end of the boom to swing vertically relative to the boom, a working tool mounted on the free end of the stick, a quick-disconnect coupling between the boom and the stick including a male coupling member pivotally mounted on the boom and a female coupling member mounted on the stick, a support member extending laterally from a side of each of the coupling members so that the support members are in opposed parallel relation to each other when the coupling members are in complete engaging relation, means on said coupling members for pivotally connecting the members at one of their ends during coupling and swinging the other of their ends toward each other until the members are fully engaged, a power coupling including a male and a female coupling element, valve means in each of said coupling elements closing the hydraulic lines when the coupling elements are separated and automatically opening the lines when they are in mating relation, means for mounting the male coupling element on one of the support members and to one of a power supply or power receiving lines and means for mounting the female coupling element on the other of the support members and to the other of power supply or power receiving lines, said mounting means of said coupling elements coacting to provide X, Y and Z alignment of the coupling elements during coupling thereof, the improvement in the means mounting the coupling elements on said support members comprising a gimbal mechanism for one of the coupling elements and a laterally movable mechanism for the other of the coupling elements, whereby the coupling elements will align with each other prior to and after the coupling members are brought into complete engaging relation.

* * * * *